US008309925B2

(12) United States Patent
Mendis et al.

(10) Patent No.: US 8,309,925 B2
(45) Date of Patent: Nov. 13, 2012

(54) RESONANT CAVITY INTEGRATED INTO A WAVEGUIDE FOR TERAHERTZ SENSING

(75) Inventors: Rajind Mendis, Houston, TX (US); Daniel M. Mittleman, Houston, TX (US)

(73) Assignee: William Marsh Rice University, Houston, TX (US)

( * ) Notice: Subject to any disclaimer, the term of this patent is extended or adjusted under 35 U.S.C. 154(b) by 680 days.

(21) Appl. No.: 12/561,978

(22) Filed: Sep. 17, 2009

(65) Prior Publication Data

US 2011/0063054 A1 Mar. 17, 2011

(51) Int. Cl.
*H01P 7/06* (2006.01)

(52) U.S. Cl. ..... 250/336.1; 250/338.1; 250/330; 333/208; 333/227; 333/230; 333/239; 333/248; 385/129; 385/130; 385/131

(58) Field of Classification Search ..... 250/336.1
See application file for complete search history.

(56) References Cited

U.S. PATENT DOCUMENTS

| | | | | |
|---|---|---|---|---|
| 7,218,190 | B2 * | 5/2007 | Engheta et al. | 333/239 |
| 7,419,887 | B1 | 9/2008 | Quick et al. | |
| 8,039,801 | B2 * | 10/2011 | Kasai et al. | 250/341.1 |
| 2005/0031295 | A1 * | 2/2005 | Engheta et al. | 385/147 |
| 2006/0086809 | A1 * | 4/2006 | Shanks et al. | 235/492 |
| 2008/0129453 | A1 * | 6/2008 | Shanks et al. | 340/10.1 |
| 2008/0204127 | A1 * | 8/2008 | Choi | 327/551 |
| 2009/0134329 | A1 * | 5/2009 | Kasai et al. | 250/338.1 |
| 2009/0273532 | A1 | 11/2009 | Mendis et al. | |
| 2010/0150512 | A1 * | 6/2010 | Berini et al. | 385/130 |
| 2011/0114856 | A1 * | 5/2011 | Cooke | 250/492.22 |

OTHER PUBLICATIONS

Prasad, Tushar, et al., "Superprism effect in a metal-clad terahertz photonic crystal slab," Optics Letters, Mar. 15, 2007, pp. 683-685, vol. 32, No. 6, Optical Society of America.

Provisional patent application entitled "Ultra low loss waveguide for broadband terahertz radiation," by Rajind Mendis, et al., filed May 2, 2008 as U.S. Appl. No. 61/049,887.

Slavik, Radan, et al., "Ultrahigh resolution long range surface plasmon-based sensor," Sensors and Actuators B, 2007, pp. 10-12, vol. 123, Elsevier B.V.

Sun, Yimin, et al., "Modulated terahertz responses of split ring resonators by nanometer thick liquid layers," Applied Physics Letters, 2008, pp. 221101-1 to 221101-3, vol. 92, American Institute of Physics.

Tiang, C. K., et al., "Electromagnetic simulation of terahertz frequency range filters for genetic sensing," Journal of Applied Physics, 2006, pp. 066105-1 to 066105-3, vol. 100, American Institue of Physics.

Verdeyen, Joseph T., "Laser Electronics," Third Edition, 1981, 2 pages, Prentice-Hall, Inc., Englewood Cliffs, New Jersey, USA.

(Continued)

*Primary Examiner* — David Porta
*Assistant Examiner* — Djura Malevic
(74) *Attorney, Agent, or Firm* — Conley Rose, P.C.; Rodney B. Carroll

(57) ABSTRACT

A method comprising polarizing and coupling an electromagnetic beam to a first-order transverse electric ($TE_1$) mode with respect to a parallel plate waveguide (PPWG) integrated resonator comprising two plates and a cavity, sending the electromagnetic beam into the PPWG integrated resonator to excite the cavity by the $TE_1$ mode and cause a resonance response, and obtaining wave amplitude data that comprises a resonant frequency, and obtaining the refractive index of fluids filling the cavity via the shift in resonant frequency.

20 Claims, 14 Drawing Sheets

OTHER PUBLICATIONS

Wächter, Markus, et al., "Metallic slit waveguide for dispersion-free low-loss terahertz signal transmission," Applied Physics Letters, 2007, pp. 061111-1 to 061111-3, vol. 90, American Institute of Physics.
Wang, Kanglin, et al., "Guided propagation of terahertz pulses on metal wires," J. Opt. Soc. Am. B, Sep. 2005, pp. 2001-2008, vol. 22, No. 9, Optical Society of America.
Wang, Kanglin, et al., "Metal wires for terahertz wave guiding," Nature, www.nature.com/nature, Nov. 18, 2004, pp. 376-379, vol. 432, Nature Publishing Group.
Yee, Cristo M., et al., "High-Q terahertz microcavities in silicon photonic crystal slabs," Applied Physics Letters, 2009, pp. 154104-1 to 154104-3, vol. 94 American Institute of Physics.
Yoshida, H., et al., "Terahertz sensing method for protein detection using a thin metallic mesh," Applied Physics Letters, 2007, pp. 253901-1 to 253901-3, vol. 91, American Institute of Physics.
Zhang, Jiangquan, et al., "Waveguide terahertz time-domain spectroscopy of nanometer water layers," Optics Letters, Jul. 15, 2004, pp. 1617-1619, vol. 29, No. 14, Optical Society of America.
Zhao, Yuguang, et al., "2-D terahertz metallic photonic crystals in parallel-plate waveguides," IEEE Transactions on Microwave Theory and Techniques, Apr. 2007, pp. 656-663, vol. 55, No. 4, IEEE.
Abele, Thomas A., et al., "A high-capacity digital communication system using TE01 transmission in circular waveguide," Apr. 1975, pp. 326-333, vol. MTT-23, No. 4, IEEE Transactions on Microwave Theory and Techniques.
Awad, M. M., et al., "Transmission terahertz waveguide-based imaging below the diffraction limit," Applied Physics Letters, 2005, pp. 221107-1 to 221107-3, vol. 86, American Institute of Physics.
Balanis, Constantine A., "Advanced engineering electromagnetics," 1989, 1 page, John Wiley & Sons, Inc., USA.
Bingham, A. L., et al., "High Q, one-dimensional terahertz photonic waveguides," Applied Physics Letters, 2007, pp. 091105-1 to 091105-3, vol. 90, American Institute of Physics.
Bingham, A. L., et al., "Terahertz two-dimensional high-Q photonic crystal waveguide cavities," Optics Letters, Feb. 15, 2008, pp. 348-350, vol. 33, No. 4, Optical Society of America.
Bowden, Bradley, et al., "Silver/polystyrene-coated hollow glass waveguides for the transmission of terahertz radiation," Optics Letters, Oct. 15, 2007, pp. 2945-2947, vol. 32, No. 20, Optical Society of America.
Cao, Hua, et al., "Broadband generation of terahertz radiation in a waveguide," Optics Letters, Aug. 1, 2004, pp. 1751-1753, vol. 29, No. 15, Optical Society of America.
Coleman, S., et al., "A THz transverse electromagnetic mode two-dimensional interconnect layer incorporating quasi-optics," Applied Physics Letters, Nov. 3, 2003, pp. 3656-3658, vol. 83, No. 18, American Institute of Physics.
Coleman, S., et al., "Parallel plate THz transmitter," Applied Physics Letters, Feb. 2, 2004, pp. 654-656, vol. 84, No. 5, American Institute of Physics.
Cooke, D. G., et al., "Optical modulation of terahertz pulses in a parallel plate waveguide," Optics Express, Sep. 15, 2008, pp. 15123-15129, vol. 16, No. 19, Optical Society of America (OSA).
Debus, Christian, et al., "Frequency selective surfaces for high sensitivity terahertz sensing," Applied Physics Letters, 2007, pp. 184102-1 to 184102-3, vol. 91, American Institute of Physics.
Gallot, G., et al., "Terahertz waveguides," J. Opt. Soc. Am. B, May 2000, pp. 851-863, vol. 17, No. 5, Optical Society of America.
Garmire, E., et al., "Flexible infrared-transmissive metal waveguides," Applied Physics Letters, Aug. 15, 1976, pp. 254-256, vol. 29, No. 4, American Institute of Physics.
Garmire, E., et al., "Low-loss optical transmission through bent hollow metal waveguides," Applied Physics Letters, Jul. 15, 1977, pp. 92-94, vol. 31, No. 2, American Institute of Physics.
George, Paul A., et al., "Integrated waveguide-coupled terahertz microcavity resonators," Applied Physics Letters, 2007, pp. 191122-1 to 191122-3, vol. 91, American Institute of Physics.
George, Paul A., et al., "Microfluidic devices for terahertz spectroscopy of biomolecules," Optics Express, Feb. 4, 2008, pp. 1577-1582, vol. 16, No. 3, Optical Society of America (OSA).
Han, H., et al., "Terahertz pulse propagation in a plastic photonic crystal fiber," Applied Physics Letters, Apr. 15, 2002, pp. 2634-2636, vol. 80, No. 15, American Institute of Physics.
Harsha, S. Sree, et al., "High-Q terahertz Bragg resonances within a metal parallel plate waveguide," Applied Physics Letters, 2009, pp. 091118-1 to 091118-3, vol. 94, American Institute of Physics.
Hecht, Jeff, "Understanding fiber optics," Fifth Edition, 2006, 1 cover page and 1 publishing page, copyright by Jeff Hecht and published by Pearson Education, Inc., Upper Saddle River, New Jersey.
Henzie, Joel, et al., "Multiscale patterning of plasmonic metamaterials," www.nature.com/naturenanotechnology, Sep. 2007, pp. 549-554, vol. 2, Nature Publishing Group.
Jamison, S. P., et al., "Single-mode waveguide propagation and reshaping of sub-ps terahertz pulses in sapphire fibers," Applied Physics Letters, Apr. 10, 2000, pp. 1987-1989, vol. 76, No. 15, American Institute of Physics.
Jeon, Tae-In, et al., "Direct optoelectronic generation and detection of sub-ps-electrical pulses on sub-mm-coaxial transmission lines," Applied Physics Letters, Dec. 20, 2004, pp. 6092-6094, vol. 85, No. 25, American Institute of Physics.
Jeon, Tae-In, et al., "THz Sommerfeld wave propagation on a single metal wire," Applied Physics Letters, 2005, pp. 161904-1 to 161904-3, vol. 86, American Institute of Physics.
Jian, Zhongping, et al., "Defect modes in photonic crystal slabs studied using terahertz time-domain spectroscopy," Optics Letters, Sep. 1, 2004, pp. 2067-2069, vol. 29, No. 17, Optical Society of America.
Jiang, Y, et al., "Improved performance of an optically pumped FIR laser using metallic waveguide," Rev. Sci. Instrum., Oct. 1992, pp. 4672-4674, vol. 63, No. 10, American Institute of Physics.
Kiwa, Toshihiko, et al., "A terahertz chemical microscope to visualize chemical concentrations in microfluidic chips," Japanese Journal of Applied Physics, 2007, pp. L1052-L1054, vol. 46, No. 44, The Japan Society of Applied Physics.
Kurt, Hamza, et al., "Coupled-resonator optical waveguides for biochemical sensing of nanoliter volumes of analyte in the terahertz region," Applied Physics Letters, 2005, pp. 241119-1 to 241119-3, vol. 87, American Institute of Physics.
Kuswandi, Bambang, et al., "Optical sensing systems for microfluidic devices: a review," Analytica Chimica Acta, 2007, pp. 141-155, vol. 601, Elsevier B.V.
Laman, N., et al., "High-resolution waveguide THz spectroscopy of biological molecules," Biophysical Journal, Feb. 2008, pp. 1010-1020, vol. 94, No. 3, Biophysical Society.
Liu, Q., et al., "Refractive-index sensor based on long-range surface plasmon mode excitation with long-period waveguide grating," Optics Express, May 11, 2009, pp. 7933-7942, vol. 17, No. 10, Optical Society of America (OSA).
Lu, Xinchao, et al., "Terahertz localized plasmonic properties of subwavelength ring and coaxial geometries," Applied Physics Letters, 2009, pp. 181106-1 to 181106-3, vol. 94, American Institute of Physics.
Marcuvitz, N., Editor, "Waveguide handbook," First Edition, 1951, 1 cover page and 1 publishing page, The McGraw-Hill Book Company, Inc., USA.
Melinger, Joseph S., et al., "High-resolution waveguide terahertz spectroscopy of partially oriented organic polycrystalline films," J. Phys. Chem. A, 2007, pp. 10977-10987, vol. 111, No. 43, American Chemical Society.
Melinger, Joseph S., et al., "Line narrowing of terahertz vibrational modes for organic thin polycrystalline films within a parallel plate waveguide," Applied Physics Letters, 2006, pp. 251110-1 to 251110-3, vol. 89, American Institute of Physics.
Mendis, Rajind, et al., "A beam-scanning THz prism with effective refractive index less than unity," undated but admitted to be prior art, 1 page, (presented at the International Workshop on Optical Terahertz Science and Technology, California, USA, 2009).
Mendis, Rajind, et al., "An investigation of the lowest-order transverse-electric (TE1) mode of the parallel-plate waveguide for THz pulse propagation," J. Opt. Soc. Am. B, Sep. 2009, pp. A6-A13, vol. 26, No. 9, Optical Society of America.

Mendis, Rajind, "Comment on 'low-loss terahertz ribbon waveguides'," Applied Optics, Aug. 10, 2008, pp. 4231-4234, vol. 47, No. 23, Optical Society of America.
Mendis, Rajind, et al., Comparison of the lowest-order transverse-electric (TE1) and transverse-magnetic (TEM) modes of the parallel-plate waveguide for terahertz pulse applications, Optics Express, Aug. 17, 2009, pp. 14839-14850, vol. 17, No. 17, Optical Society of America (OSA).
Mendis, R., "Guided-wave THz time-domain spectroscopy of highly doped silicon using parallel-plate waveguides," Electronics Letters, Jan. 5, 2006, 2 pages, vol. 42, No. 1, IEE.
Mendis, R., et al., "Plastic ribbon THz waveguides, Journal of Applied Physics," Oct. 1, 2000, pp. 4449-4451, vol. 88, No. 7, American Institute of Physics.
Mendis, R., et al., "THz interconnect with low-loss and low-group velocity dispersion," IEEE Microwave and Wireless Components Letters, Nov. 2001, pp. 444-446, vol. 11, No. 11, IEEE.
Mendis, Rajind, "THz transmission characteristics of dielectric-filled parallel-plate waveguides," Journal of Applied Physics, 2007, pp. 083115-1 to 083115-4, vol. 101, American Institute of Physics.
Mendis, R., et al., "Undistorted guided-wave propagation of subpicosecond terahertz pulses," Optics Letters, Jun. 1, 2001, pp. 846-848, vol. 26, No. 11, Optical Society of America.
Mendis, Rajind, et al., "Whispering-gallery-mode THz-pulse propagation on a single curved metallic plate," paper CThQ1, 2009, 2 pages, Optical Society of America, OSA/CLEO/IQEC 2009, IEEE.
Mizushima, Y., et al., "Ultralow loss waveguide for long distance transmission," Oct. 1, 1980, pp. 3259-3260, vol. 19, No. 19, Applied Optics.
Nagel, M., et al., Integrated THz technology for label-free genetic diagnostics, Applied Physics Letters, Jan. 7, 2002, pp. 154-156, vol. 80, No. 1, American Institute of Physics.
Nagel, M., et al., "Modular parallel-plate THz components for cost-efficient biosensing systems," Semiconductor Science and Technology, 2005, pp. S281-S285, vol. 20, Institute of Physics (IOP) Publishing Ltd, United Kingdom.
Nagel, M., et al., "THz biosensing devices: fundamentals and technology," Journal of Physics: Condensed Matter, 2006, pp. S601-S618, vol. 18, IOP (Institute of Physics) Publishing Ltd, United Kingdom.
Nishihara, H., et al., "Low-loss parallel-plate waveguide at 10.6 μm," Applied Physics Letters, Oct. 1, 1974, pp. 391-393, vol. 25, No. 7, American Institute of Physics.
O'Hara, John F., et al., "Thin-film sensing with planar terahertz metamaterials: sensitivity and limitations," Optics Express, Feb. 4, 2008, pp. 1786-1795, vol. 16, No. 3, Optical Society of America (OSA).
Office Action dated Sep. 30, 2011 (17 pages), U.S. Appl. No. 12/434,454, filed May 1, 2009.
Office Action dated Mar. 14, 2012 (9 pages), U.S. Appl. No. 12/434,454, filed May 1, 2009.

* cited by examiner

RESONANT CAVITY INTEGRATED INTO A WAVEGUIDE FOR TERAHERTZ SENSING

STATEMENT REGARDING FEDERALLY SPONSORED RESEARCH OR DEVELOPMENT

This invention was made with government support under grant number EECS-0724996 awarded by the National Science Foundation and grant number FA8650-07-2-5061 awarded by the Air Force Office of Scientific Research. The Government has certain rights in the invention.

CROSS-REFERENCE TO RELATED APPLICATIONS

Not applicable.

REFERENCE TO A MICROFICHE APPENDIX

Not applicable.

BACKGROUND

Various engineered waveguides or structures with electromagnetic resonant characteristics have been studied for optical sensing applications, such as noninvasive refractive index monitoring. Many of the structures exhibit resonance responses, where a dip in transmission occurs at a characteristic resonant frequency. The resonant frequency can be substantially dependent on the refractive index of the surrounding medium, and consequently be used as a highly sensitive measure for changes in the refractive index. For example, planar integrated waveguide resonators and asymmetric split ring arrays have been used to detect Deoxyribonucleic acid (DNA) hybridization and denaturing. Additionally, coupled Terahertz (THz) resonators and resonant metal meshes have been studied for biomedical sensing, and planar structures have been used to study nanometer-thick films of material. However, most of the structures that have been studied have planar or open geometry, which is not compatible for flow monitoring in microfluidics platforms and on-line applications. Further, the resonant frequency linewidth of such structures limits the refractive index detection resolution, where sub-linewidth shifts in resonant frequency are difficult to detect.

Electromagnetic radiation at THz frequencies and submillimeter wavelengths have also being investigated for sensing applications. One of the waveguide structures that have been examined to transport the waves at THz frequencies is the parallel plate waveguide (PPWG), which comprises two parallel metal plates. The PPWG has been investigated for its promising wave propagation characteristics, such as relatively lower attenuation and distortion at THz frequencies and no low frequency cutoff. However, no effective PPWG integrated resonators have been successfully introduced.

SUMMARY

In one embodiment, the disclosure includes a method comprising polarizing and coupling an electromagnetic beam to a first-order transverse electric ($TE_1$) mode with respect to a PPWG integrated resonator comprising two plates and a cavity, sending the electromagnetic beam into the PPWG integrated resonator to excite the cavity by the $TE_1$ mode and cause a resonance response, and obtaining wave amplitude data that comprises a resonant frequency.

In another embodiment, the disclosure includes an apparatus comprising two plates substantially parallel to one another and separated by less than about two millimeters; and an antenna coupled to the two plates and configured to transmit or receive a wave having a frequency in a range of frequencies between about one Gigahertz (GHz) to about ten THz, wherein the antenna is further configured to couple a $TE_1$ mode into the two plates, and wherein one of the two plates comprises a groove machined along its length that has a resonance response for the $TE_1$ mode in the range of frequencies These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a system and method for sensing refractive index values and changes using a PPWG integrated resonator and THz frequencies. The PPWG integrated resonator may comprise two parallel metal plates and a channel or cavity along the length of one of its two plates. The plates may have dimensions on the order of millimeters or few millimeters, and the cavity may have dimensions on the order of about one millimeter or less and may contain a material, such as a fluid. A wave beam may be coupled to the PPWG integrated resonator, and used to transmit a $TE_1$ mode wave at THz frequencies. The $TE_1$ mode wave may propagate between the two plates, interact with the cavity, and exhibit a resonance response, where a dip in transmission may occur at a resonant frequency. The resonant frequency may be substantially dependent on the refractive index of the material in the cavity. Accordingly, relatively small changes in the refractive index of the material may cause substantial shifts in the resonant frequency, which may be detected and used to measure the refractive index values with significant accuracy. The PPWG integrated resonator may have higher detection resolution and higher sensitivity to changes in refractive index, and thus may be more suitable than other resonators or sensors for monitoring flows in microfluidics platforms and in situ applications.

Figure 1A:
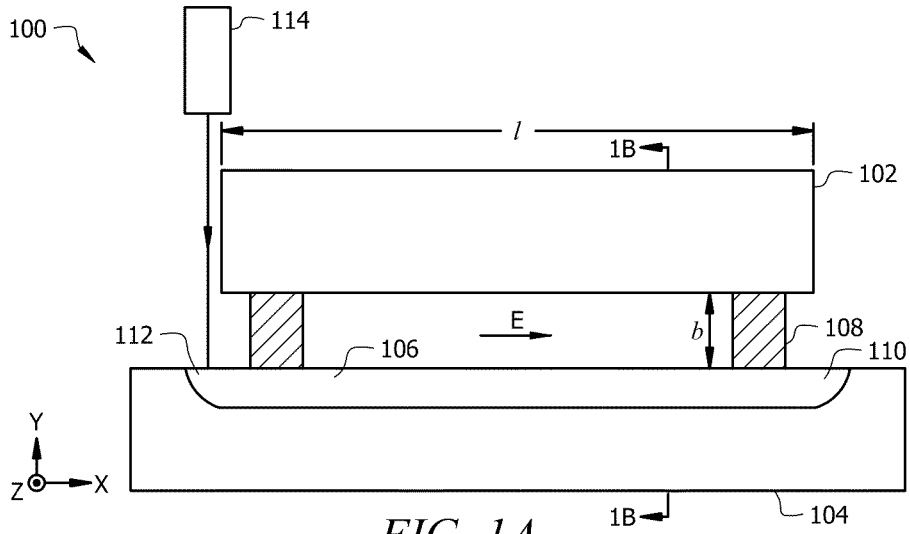
FIG. 1A is a front view of an embodiment of a PPWG integrated resonator.

FIG. 1A illustrates one embodiment of a PPWG integrated resonator 100, which may be used for measuring refractive index of fluids at THz frequencies. The PPWG integrated resonator 100 may comprise a top plate 102, a bottom plate 104, and a cavity 106. The top plate 102 and bottom plate 104 may be substantially parallel and may be made from electrical conducting material for THz frequencies, such as aluminum or other metal. The top plate 102 may have a length l and may be separated from the bottom plate 104 by a separation distance b. For example, in FIG. 1A, the length l may be in the x direction and the separation distance b may be in the y direction. The separation distance b may be on the order of few millimeters and comprise air or other gas. For example, b may be equal to about one millimeter, or about two millimeters. The length l may be on the order of millimeters or a few centimeters. The bottom plate 104 may also have a length close to about l and may be longer than the top plate 102 to allow adding and/or monitoring a fluid in the cavity 106. The thickness of the top plate 102 and bottom plate 104 may also be on the order of millimeters. Additionally, the top plate 102 and the bottom plate 104 may be coupled to at least one spacer 108, which may be used to separate the two plates. For instance, a spacer may be placed between each of the two edges along the length of the top plate 102 and bottom plate 104. The spacer may be made from a non electrical conducting material, such as glass or any other dielectric material.

The cavity 106 may be a groove machined or mechanically drilled in the bottom plate 104 and may be oriented along the length of the bottom plate 104. The cavity 106 may be used as a channel for containing a fluid, e.g. gas or liquid. In an embodiment, the two edges along the length of the cavity 106 may have upward slopes, for instance to allow the flow of fluid from an inlet 110 at one end to an outlet 112 at the other end. The cavity 106 may be filled with the fluid using a syringe or a pump, for instance via a tube coupled to the inlet 110. The fluid may be allowed to flow from the inlet 110 through the cavity and out via the outlet 112, which may be coupled to another tube. In an embodiment, a relatively thin dielectric layer, e.g. plastic layer, may be placed on top of the cavity 106 or on top of the bottom plate 104 to cover the fluid inside the cavity 106, and thus limit the fluid volume at about the cavity 106 volume by preventing the fluid from overfilling the cavity 106. However, the dielectric layer may not cover the inlet 110 and the outlet 112 to allow the fluid to flow in the cavity 106. The thickness of the dielectric layer and the material of which it is composed may be chosen such that it may be fairly invisible to the propagating wave.

In an embodiment, the PPWG integrated resonator 100 may also be coupled to a laser 114, which may be used to monitor the level of fluid in the cavity 106 and to determine the fluid volume in the cavity. For instance, the laser 114 may be a semiconductor laser or gas laser (e.g., a HeNe laser) that may be coupled to one end of the cavity 106, e.g. at the outlet 112, and may be substantially inclined to the top surface of the bottom plate 104 and the floor of the cavity 106. Accordingly, a laser beam may be projected onto the surface of the fluid in the cavity 106 and the displacement of the corresponding reflected beam may be detected and analyzed to measure the level of fluid.

Figure 1B:
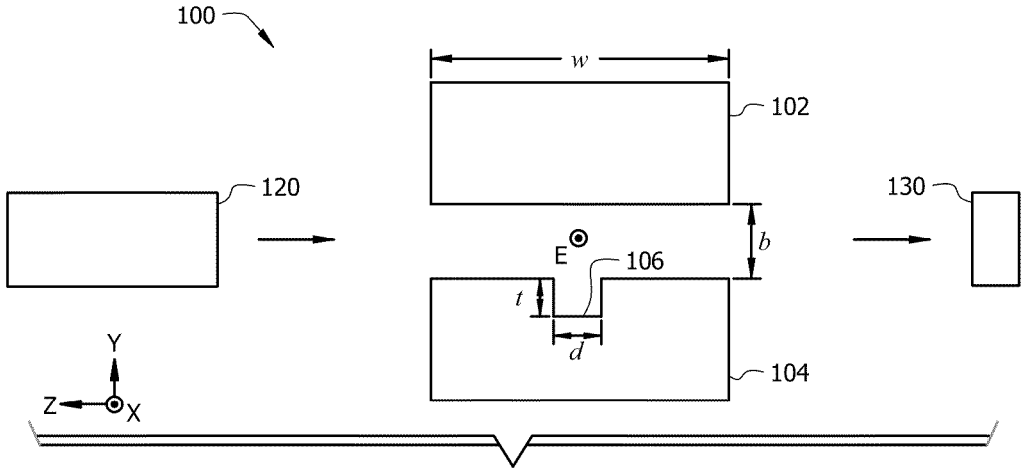
FIG. 1B is a section view of the PPWG integrated resonator.

FIG. 1B illustrates a section view across line 1B-1B in FIG. 1A. As shown in FIG. 1B, the top plate 102 and similarly the bottom plate 104 may have a width w, for example in the z direction. The width w may be on the order of few millimeters and may be smaller than the length l and larger than the separation distance b. The cavity 106 may be positioned at about the middle of the bottom plate 104 and may have a width d less than about one millimeter. Similarly, a thickness t of the cavity 106 may be less than about one millimeter or equal to about the width d. Additionally, the fluid in the cavity 106 may have a volume of about few micro liters. In the case of such cavity dimensions, the cavity 106 may cause a resonance response for an electromagnetic wave propagating in the PPWG integrated resonator 100 at THz frequencies.

For instance, a transmitter or emitter 120, such as an antenna, may be coupled to the PPWG integrated resonator 100 at one side. The transmitter 120 may be used to transmit a wave beam between the plates 102 and 104 at a single or a plurality of THz frequencies, for example from about one hundred GHz to about ten THz. The transmitter 120 may also polarize the wave with respect to the direction of the plates, such as in the $TE_1$ mode. Specifically, the wave may be propagated between the plates 102 and 104 along the width w (e.g. in the z direction) and may have an electric field (E) in the direction parallel to the length l of the plates 102 and 104 (e.g. in the x direction), which may be referred to as a transverse electric (TE) mode. As such, the electric field of the wave may interact with the cavity 106 while propagating along the width d and exhibit a resonance response around a resonant frequency, which may be dependent on the width d and thickness t. The resonance response may be a substantial decrease in transmission at about the resonant frequency in comparison to the neighboring frequencies, as described in more detail below.

Additionally, a receiver 130 may be coupled to the other side of the PPWG integrated resonator prototype 100, which may be used to receive a wave at a single or a plurality of frequencies from the PPWG integrated resonator 100. The top plate 102 and bottom plate 104 may also comprise a plurality of mounting holes that may be used to couple the two plates to one another (via spacers) and to mount the PPWG integrated resonator 100, for example on a mounting platform. In some embodiments, a lens, such as a silicon plano-cylindrical lens, may be coupled to the transmitter 120 and the two plates 102 and 104. The lens may be configured to focus the wave beam from the transmitter and couple the wave beam to the PPWG integrated resonator 100. For instance, the lens may adjust a diameter of the wave beam with respect to the separation distance b to prevent multiple mode propagation in the PPWG integrated resonator.

Figure 2:
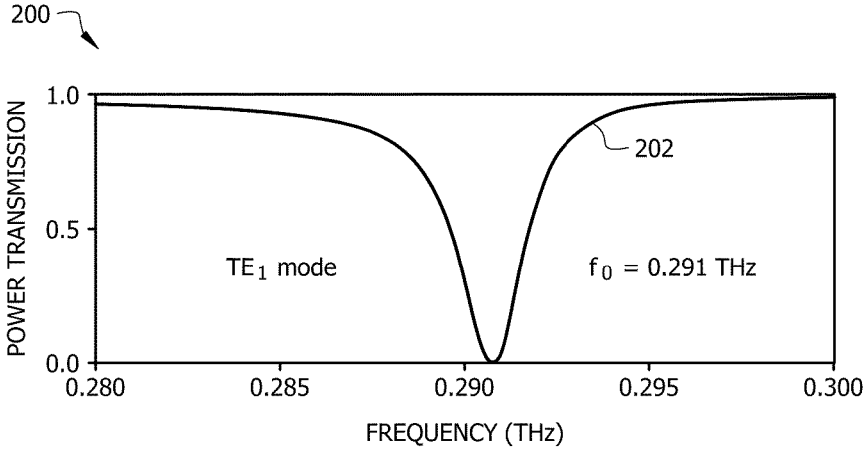
FIG. 2 is a chart of an embodiment of a frequency dependent transmission plot.

FIG. 2 illustrates an embodiment of a frequency dependent transmission plot 200 for a simulated PPWG integrated resonator model. The frequency dependent transmission plot 200 comprises a transmission curve 202 corresponding to a $TE_1$ mode through the PPWG integrated resonator. The $TE_1$ mode may be a first single TE mode that may be achievable without any other higher TE modes, where the propagating wave may suffer less attenuation in comparison to the case of multiple TE mode propagation. The transmission values are calculated using COSMOL software, which may be commercially available and based on the Finite Element Method (FEM) model for solving the Maxwell's electromagnetic equations. Specifically, the transmission values are calculated for a PPWG integrated resonator modeled similar to the PPWG integrated resonator 100, where the separation distance b is equal to about one millimeter, the width w is equal to about 6.4 millimeter, the cavity width d is equal to about 472 micrometers, the cavity thickness t is equal to about 412 micrometers, and where the cavity contains air (no test sample).

The calculated transmission values are shown for a range of frequencies from about 0.28 THz to about 0.3 THz. The transmission values range from about one to zero, which indicates a transmission range from about one hundred percent to zero percent. The transmission values are equal to about one at both ends of the frequency range, but decrease at the middle of the range to about zero at a frequency $f_o$ equal to about 0.291 THz. The dip in transmission at the frequency $f_o$ may indicate a high concentration of energy near the cavity and no substantial transmission through the PPWG integrated resonator. The frequency $f_o$ may be the resonant frequency, where the excitation of the cavity by the $TE_1$ mode may cause a resonance response. Specifically, at the resonant frequency, the $TE_1$ mode may interact more strongly with the cavity, which may lead to substantially canceling or limiting the wave propagation through the PPWG integrated resonator.

Figure 3:
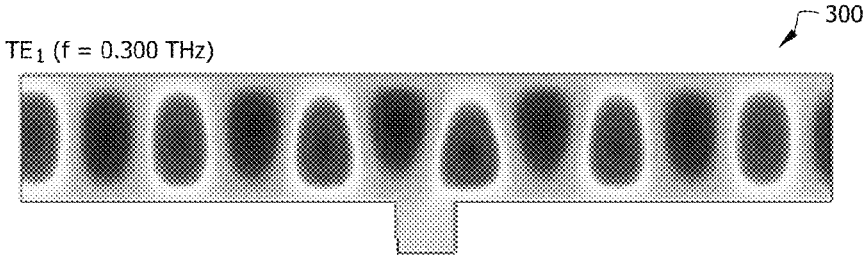
FIG. 3 is a section view of an embodiment of an axial electric field distribution in a PPWG integrated resonator.

FIG. 3 illustrates a section view of an embodiment of an axial electric field distribution 300 of the $TE_1$ mode considered in FIG. 2. In FIG. 3, the electric field strength is shown across a section view of the cavity and the separation between the two plates (which corresponds to FIG. 1B), along a plane parallel to the width w and perpendicular to the length l. The electric field corresponds to a frequency equal to about 0.3 THz at about the end of the range of frequencies in the frequency dependent transmission plot 200, where the transmission is equal to about one and there is no resonance response. At this non resonant frequency, the electric field energy is distributed between the two plates without interacting strongly with the cavity. Accordingly, the arrow in FIG. 1B shows the electric field may enter the PPWG integrated resonator 100 from the input face (to the left), propagate between the plates while oscillating at the corresponding frequency, and exit from the output face (to the right). Since the propagating wave may propagate between the plates without substantial loss, the wave transmission at this frequency may be equal to about one.

Figure 4:
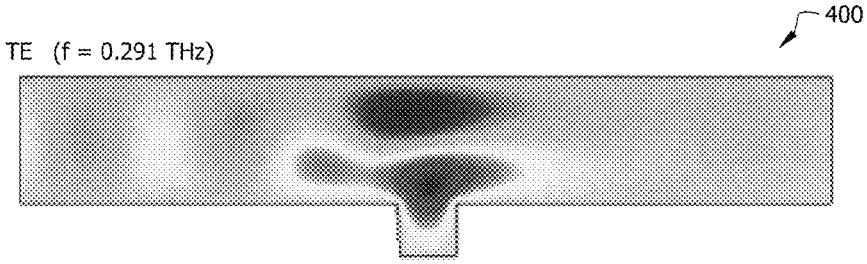
FIG. 4 is a section view of another embodiment of an axial electric field distribution in a PPWG integrated resonator.

FIG. 4 illustrates a section view of an embodiment of another axial electric field distribution 400 of the $TE_1$ mode considered in FIG. 2. In FIG. 4, the electric field strength corresponds to the resonant frequency $f_o$ at about 0.291 THz, where the transmission is equal to about zero. This resonant frequency of the electric field may match the cavity width b, which may facilitate a coupling between the electric field and the cavity and cause the electric field energy to be concentrated around the cavity. As such, no substantial energy may exist or propagate away from the cavity and thus no substantial transmission may occur at the output face of the PPWG integrated resonator. Since the cavity comprises air and no test sample, the cavity width d may also be the cavity effective width n.d, where the refractive index of air n may be equal to about one.

Figure 5:
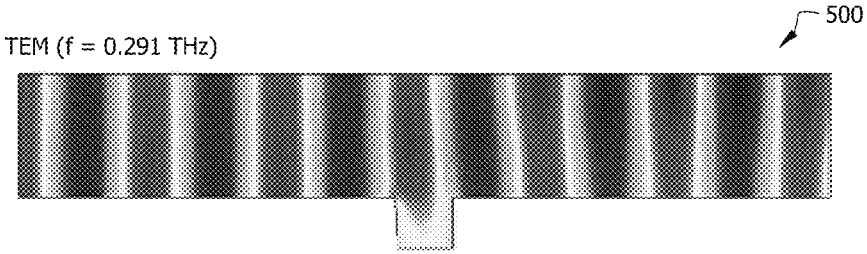
FIG. 5 is a section view of another embodiment of an axial electric field distribution in a PPWG integrated resonator.

FIG. 5 illustrates a section view of an embodiment of another axial electric field distribution 500 that corresponds to a TEM mode. Specifically, the electric field in the TEM mode may be perpendicular to the inside surfaces of top plate 102 and bottom plate 104. The electric field may correspond to a wave propagating in the same PPWG integrated resonator considered in FIGS. 2, 3, and 4. The electric field strength also corresponds to the resonant frequency $f_o$ (at about 0.291 THz). In FIG. 5, the electric field energy of the TEM mode at the frequency $f_o$ is distributed between the two plates from the input face to the output face of the PPWG integrated resonator, similar to the $TE_1$ mode at the non resonant frequency 0.3 THz. Since the electric field in the TEM mode may be perpendicular to the inside plate surfaces, the electric field of the TEM mode may propagate between the plates and oscillate at any frequency without substantially coupling to the cavity and hence without exciting the cavity and causing a resonance response. Thus, in the same range of frequencies examined for the $TE_1$ mode, the wave transmission for the TEM mode may not comprise a substantial dip or reduction in transmission around a resonant frequency and may be substantially constant or monotonic.

Figure 6:
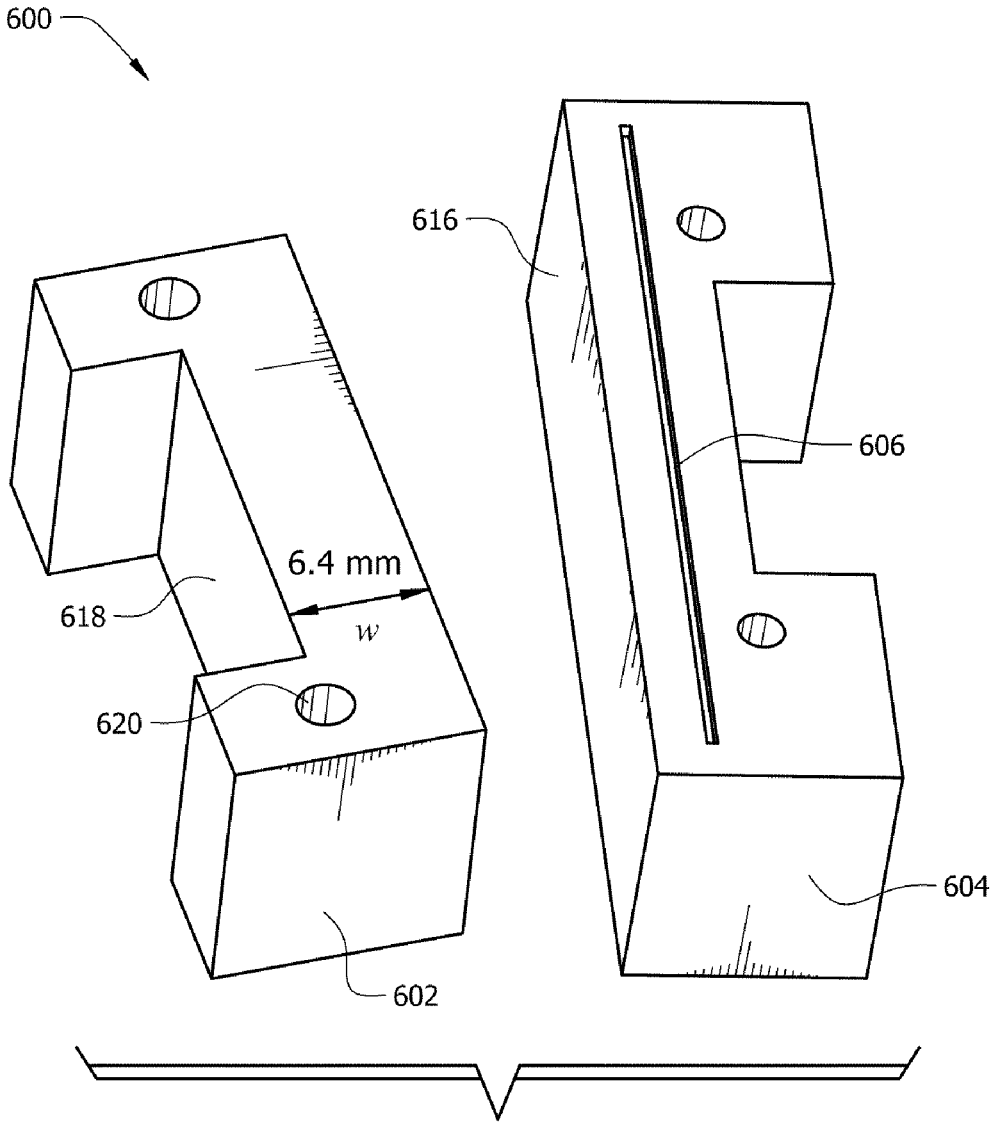
FIG. 6 is a view of an embodiment of a PPWG integrated resonator prototype.

FIG. 6 illustrates a PPWG integrated resonator prototype 600, which was machined based on the designs of the PPWG integrated resonator 100. The PPWG integrated resonator prototype 600 comprises a top plate 602, a bottom plate 604, and a cavity 606, which are configured similar to the corresponding components of the PPWG integrated resonator 100. Specifically, the width w of the top plate 602, and similarly the bottom plate 604, is equal to about 6.4 millimeters. Additionally, the cavity may contain a liquid volume equal to about eight micro liters. An input face 616 of the PPWG integrated resonator prototype 600 may be coupled to a transmitter or emitter (not shown). The transmitter may be used to transmit a wave beam between the plates 602 and 604 in the width w direction at a single or a plurality of THz frequencies, for instance from about one hundred GHz to about ten THz. The transmitter may be coupled to the PPWG integrated resonator prototype 600 via a lens and may polarize the wave in the $TE_1$ mode with respect to the direction of the plates. Additionally, an output face 618 of the PPWG integrated resonator prototype 600 may be coupled to a receiver, which may be used to receive the transmitted wave at the corresponding frequencies. The top plate 602 and bottom plate 604 may also comprise a plurality of mounting holes 620 that may be used to couple the two plates to one another and the PPWG integrated resonator prototype 600 on a mounting platform.

Figure 7:
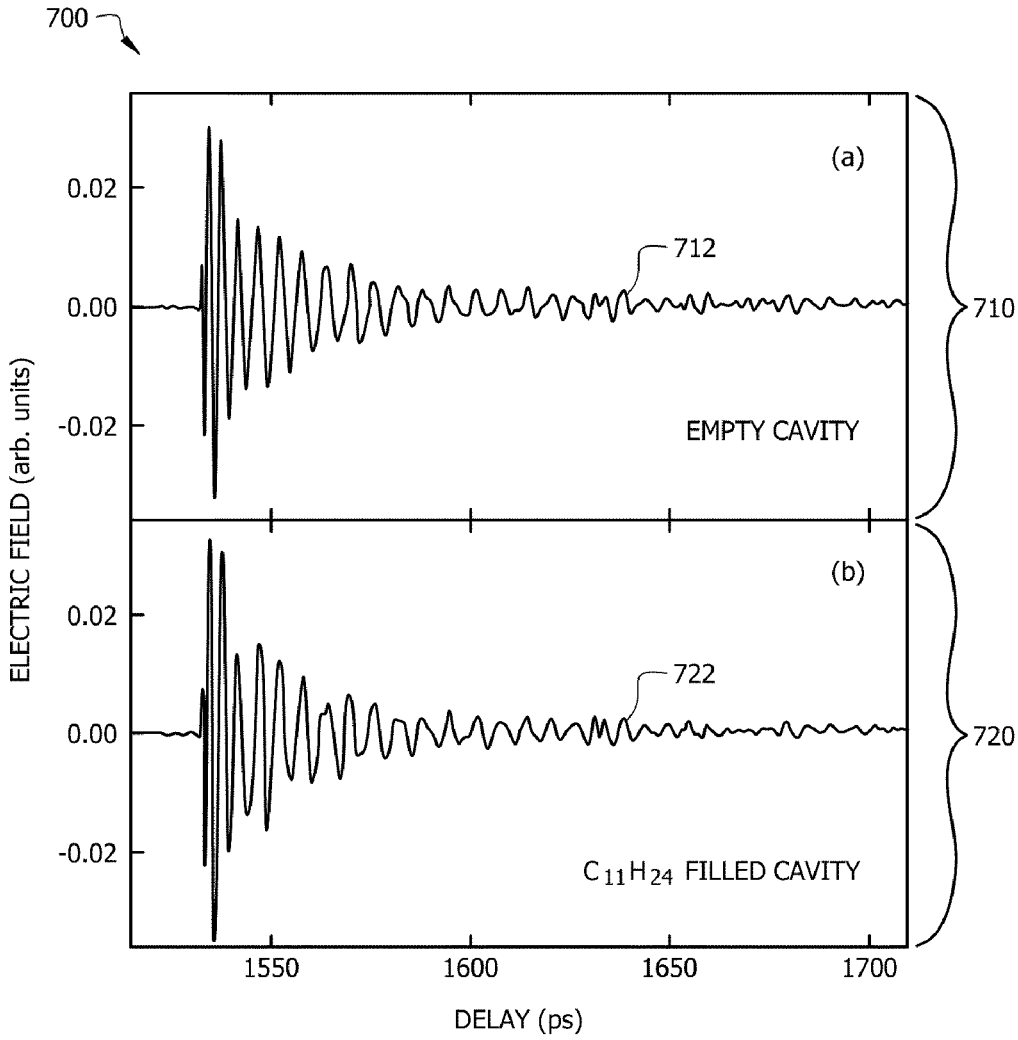
FIG. 7 is a chart of an embodiment of a plurality of time pulses.

FIG. 7 illustrates a first plot 710 and second plot 720, which comprise a first time pulse 712 and a second time pulse 722, respectively. The first time pulse 712 and second time pulse 722 comprise a plurality of wave amplitude measurements corresponding to $TE_1$ mode waves that were transmitted at THz frequencies through the PPWG integrated resonator prototype 600. The cavity of the PPWG integrated resonator contained air (no test sample) in the case of the first time pulse 712 measurements. However, in the case of the second time pulse 722 measurements, the cavity was filled with Undecane, which is a liquid alkane hydrocarbon that comprises a linear chain of hydrocarbons ($C_{11}H_{24}$) and has a well characterized and nearly frequency dependent refractive index. The THz radiation was generated and detected using a conventional commercially available (Picometrix T-Ray 4000) THz time-domain spectrometer that produces single-cycle THz pulses. Each waveform is an average of about 10,000 scans of a rapid delay line, which may require less than two minutes of averaging. The $TE_1$ mode waves were coupled into and out of the PPWG integrated resonator using conventional quasi-optics and a single-mode excitation configuration. The first time pulse 712 and second time pulse 722 are chirped and broadened due to group velocity dispersion.

Figure 8:
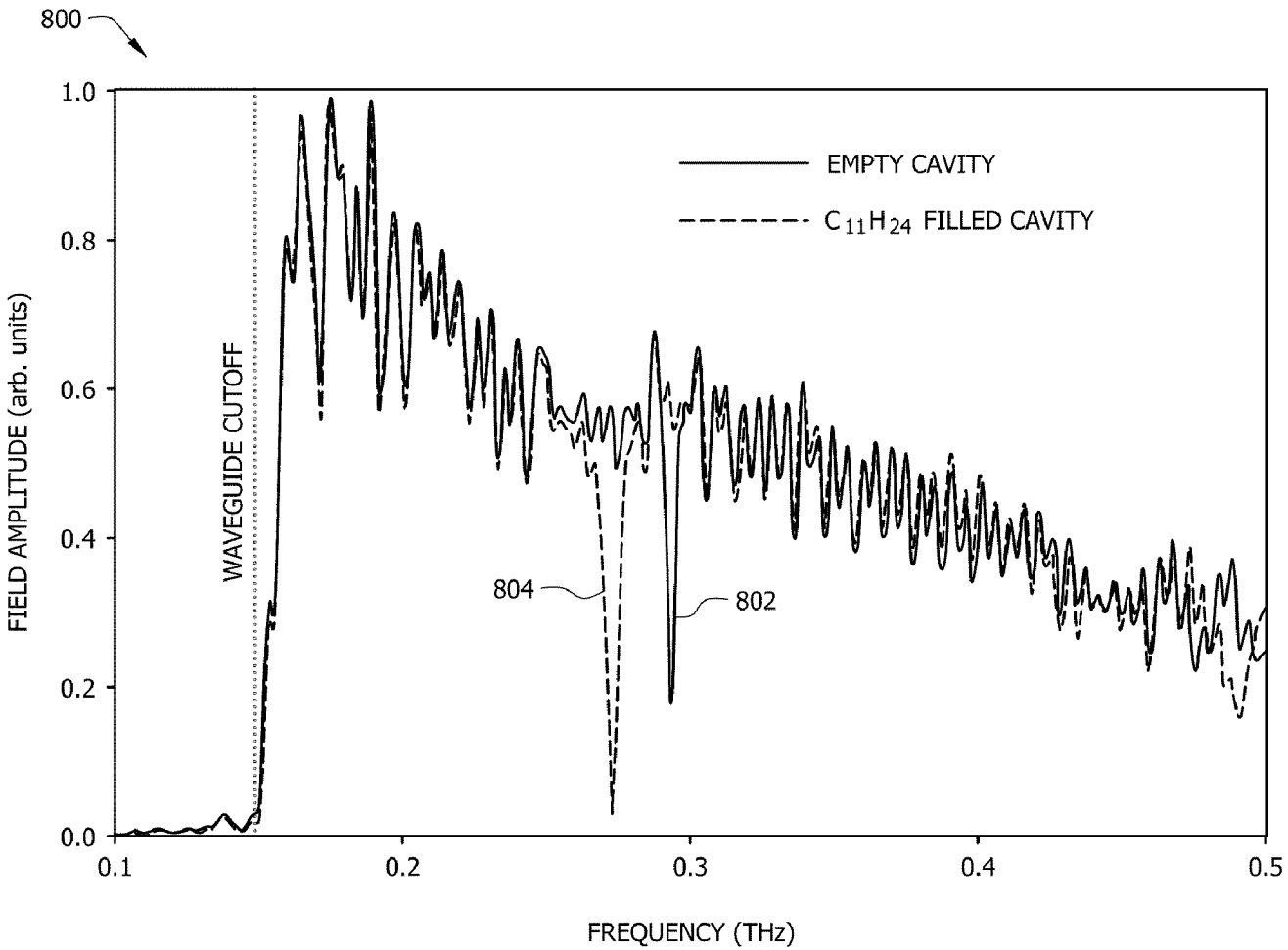
FIG. 8 is a chart of an embodiment of a frequency dependent wave amplitude plot.

FIG. 8 illustrates a frequency dependent wave amplitude plot 800 for the detected $TE_1$ mode pulses in FIG. 7 for the PPWG integrated resonator prototype 600. In FIG. 8, the amplitudes spectra are obtained using Fourier transforms of the $TE_1$ mode pulses at about 320 picoseconds and zero-padding to about 5,120 picoseconds. The frequency dependent wave amplitude plot 800 comprises a first wave amplitude curve 802 and a second wave amplitude curve 804 that represent the detected wave amplitudes for the air filled cavity case and the liquid ($C_{11}H_{24}$ liquid) filled cavity case, respectively, at a plurality of THz frequencies from about 0.1 THz to about 0.5 THz. Specifically, the wave amplitudes are detected for the $TE_1$ mode waves, where the upper and bottom plates are separated by about one millimeter and the $TE_1$ mode has a cutoff frequency equal to about 0.15 THz. At the frequencies below the cutoff frequency of the $TE_1$ mode, the amplitudes of the first wave amplitude curve 802 and the second wave amplitude curve 804 are equal to about zero. At the frequencies above the cutoff frequency of the $TE_1$ mode, the amplitudes of the first wave amplitude curve 802 and the second wave amplitude curve 804 substantially overlap over a portion of the frequency range. However, each of the curves 802 and 804 exhibit a different narrow dip in amplitude across the spectrum, which may be caused by the resonant cavity.

In the case of the first wave amplitude curve 802, the cavity contains air and the dip in amplitude is located at a corresponding resonant frequency equal to about 0.293 THz. The resonant frequency in the first wave amplitude curve 802 is equal to about the resonant frequency $f_0$ observed in the frequency dependent transmission plot 200 for the simulated PPWG integrated resonator model, which also comprises a cavity filled with air. In the case of the second wave amplitude curve 804, the cavity contains the Undecane liquid and the dip in amplitude is located at a corresponding resonant frequency that is smaller than 0.293 THz of the first wave amplitude curve 802. The shift in the resonant frequency (to the left) may be related to the change in the cavity fluid (from air to $C_{11}H_{24}$ liquid), which causes a change in the effective width and height of the cavity since the index of refraction of air is different than $C_{11}H_{24}$. As such, when the $TE_1$ mode couples to different cavities, different resonance responses (e.g. dips in amplitude) may be observed at different resonant frequencies.

Figure 9:
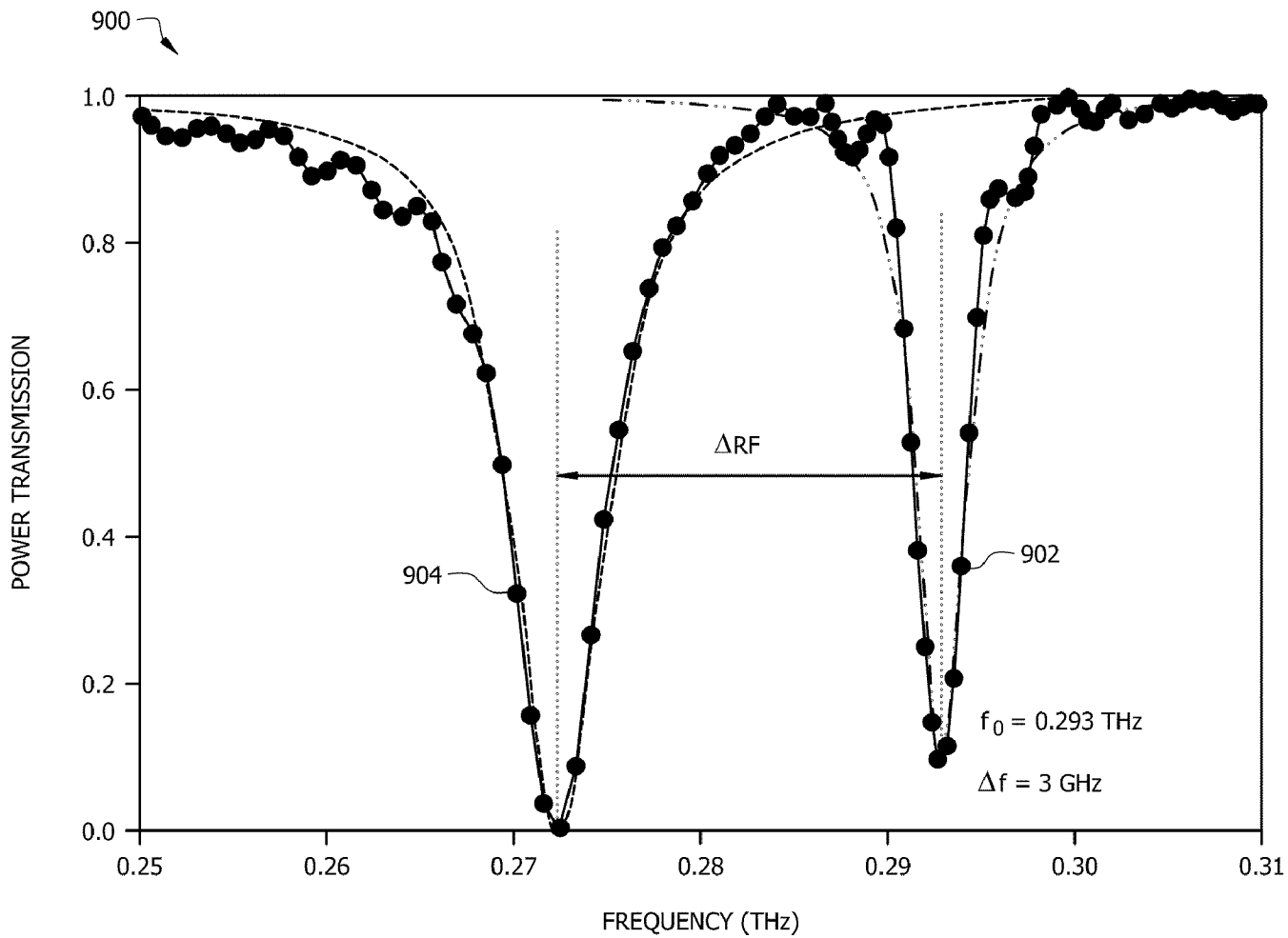
FIG. 9 is a chart of another embodiment of a frequency dependent transmission plot.

FIG. 9 illustrates a frequency dependent transmission plot 900 for the PPWG integrated resonator prototype 600 in the case of the air filled cavity and the $C_{11}H_{24}$ liquid filled cavity. The frequency dependent transmission plot 900 comprises a first transmission curve 902 corresponding to the first wave amplitude curve 802 and a second transmission curve 904 corresponding to the second wave amplitude curve 804. Specifically, the first transmission curve 902 represents the square of the ratio of the first wave amplitude curve 802 that may be a reference transmission spectrum and the second wave amplitude curve 804 that may be a sample transmission spectrum. The second transmission curve 904 represents the square of the inverse ratio of the first wave amplitude curve 802 and the second wave amplitude curve 804.

The first transmission curve 902 may represent a power transmission spectrum for the air filled cavity case and the second transmission curve 904 may represent a power transmission spectrum for the liquid filled cavity case. The power transmission spectra may be more suitable to differentiate between the resonance responses of the two cases since they comprise substantially less ripples than the corresponding wave amplitude curves, which may result from artifacts in the measured time-domain pulses. In FIG. 9, the values in the first transmission curve 902 and second first transmission curve 904 that correspond to the two measurement cases are shown using black dots. Additionally, the transmission values in the first transmission curve 902 and second first transmission curve 904 are fitted using two Lorentzian shape lines. The Lorentzian shape fit for the first transmission curve 902 indicates a resonance at about 0.293 THz and a linewidth of about three GHz at about three decibels around the dip in transmission. As for the second transmission curve 904, the Lorentzian shape fit indicates a resonance at about 0.272 THz, a linewidth of about 6 GHz, and an extinction coefficient of about 30 decibels. The quality factor (Q factor) of the obtained transmission curve (for the air filled cavity case) may be equal to about 98, which may not be larger than other resonant structures used for THz frequencies. However, the resonance linewidth at about three GHz may be smaller than previously proposed PPWG-based resonant cavity designs and many other resonators in the THz range.

In comparison to the air filled cavity case, the increase in the resonance linewidth in the case of the liquid filled cavity may be attributed to the higher refractive index of the fluid. Additionally, some increase in the resonance linewidth may be caused by the absorption property of the fluid at THz frequencies, which may not be negligible. As such, the substantial shift in the resonant frequency ΔRF, which may be caused by the change of fluid in the cavity, may be used as a sensitive and reliable measure of the change in refractive index of the material inside the cavity of the PPWG integrated resonator. For example, in FIG. 9, the shift in frequency ΔRF may be equal to about 0.02 THz, which may be substantially larger than the linewidth in the first transmission curve 902 and the second transmission curve 904.

Figure 10:
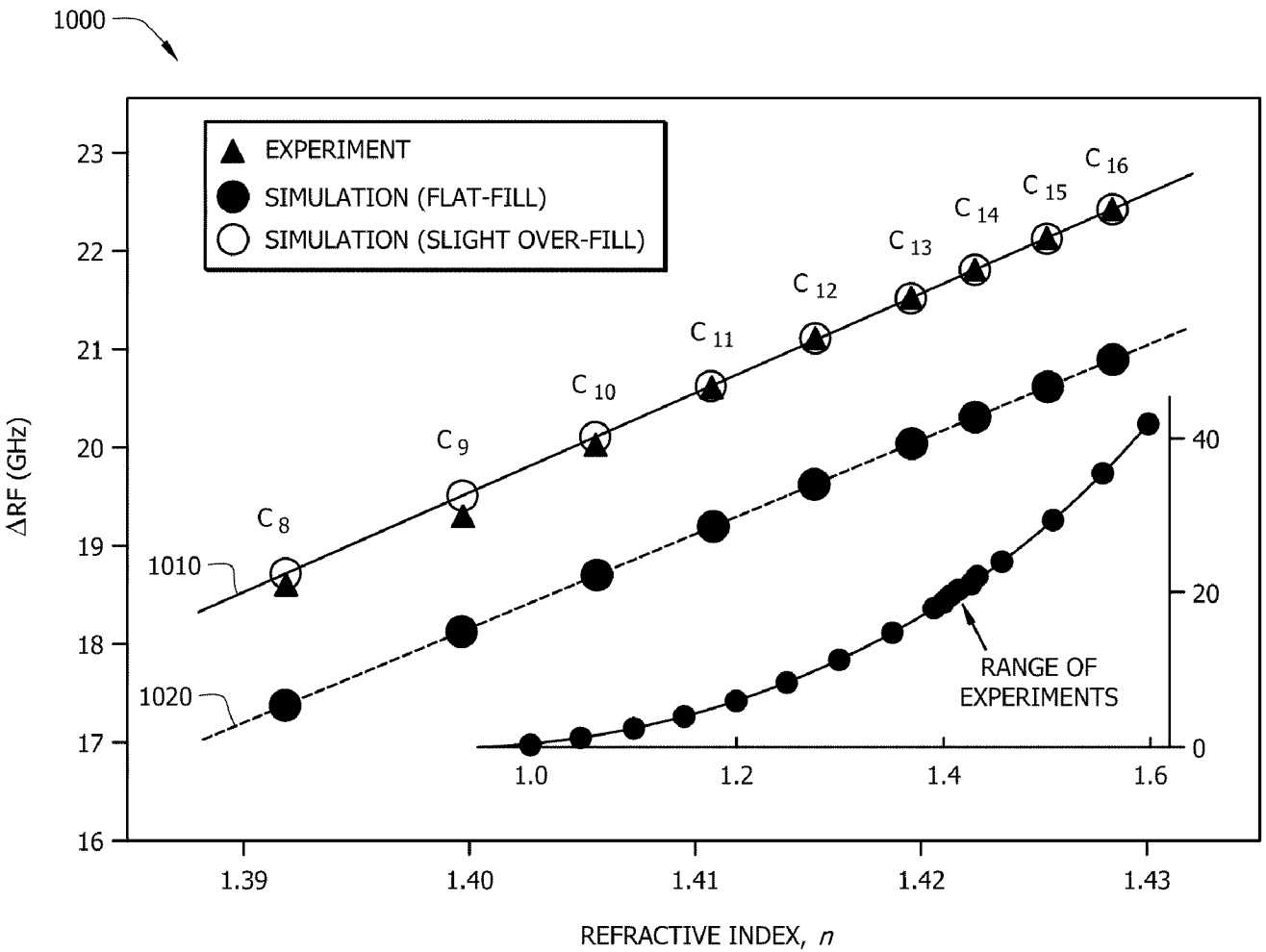
FIG. 10 is a chart of an embodiment of a resonant frequency shift plot.

FIG. 10 illustrates a resonant frequency shift plot 1000, which was obtained using the PPWG integrated resonator prototype 600. The resonant frequency shift plot 1000 comprises a first resonant frequency shift curve 1010 and a second resonant frequency shift curve 1020. The first resonant frequency shift curve 1010 comprises a plurality of measured resonant frequency shift values ΔRF (shown by black dots) for a plurality of fluids of different n-alkanes in the cavity in comparison to the air filled cavity case. The second resonant frequency shift curve 1020 comprises a plurality of simulated resonant frequency shift values ΔRF (shown by white dots) for the same fluids in the cavity. The measured and simulated resonant frequency shift values are plotted vs. the refractive index values of the fluids, which were obtained from previous studies. Each measured and simulated resonant frequency shift value is equal to the difference between the resonant frequencies of the reference transmission spectrum and the sample transmission spectrum, similar to the resonant frequency shift shown in FIG. 9.

In FIG. 10, the simulated resonant frequency shift values were obtained by modeling a cavity that is uniformly filled with the fluids without overfilling. The simulated ΔRF values are found at an offset of about one GHz from the measured ΔRF values, which may indicate some systematic error between the simulations and the measurements. A second set of simulated ΔRF values was also obtained using similar modeling as the first set of simulated ΔRF values but considering a slight overfilling of the liquids in the cavity by using a convex meniscus of about nine micrometer radius in the simulation. The second simulated ΔRF values are also shown in FIG. 10 and substantially overlap with the measured ΔRF values. Since, the cavity in the PPWG integrated resonator is open and not directly covered by a layer, the overlap between the measured ΔRF values and the second simulated ΔRF values may indicate a possible fluid overfill in the cavity during the measurements. In future studies, the matching between the measured and simulated ΔRF values may be improved by covering the cavity, for instance using a thin dielectric layer, to better determine the volume of the fluid in the cavity in simulations.

FIG. 10 also comprises (at the bottom right corner) a resonant frequency shift curve that extends the number of fluids in the first resonant frequency shift curve 1010 to a wider range of refractive indices (from about one to about 1.6). The resonant frequency shift curve at the wider range of refractive indices may reveal a nonlinear dependence of the resonant frequency shift on the refractive index of the fluid in the resonant cavity. To compare the sensitivity of the PPWG integrated resonator to other proposed resonant structures, the nonlinear resonant frequency shift curve is fitted to a quadratic function. The ratio of change in frequency to change in index $\Delta f/\Delta n$ is then calculated from the quadratic curve and found equal to about 91.25 GHz/refractive index unit (RIU) for n values around 1.4. This $\Delta f/\Delta n$ value may also be converted to the conventional ratio of change in wavelength to change in index $\Delta\lambda/\Delta n$ value equal to about $3.7\times10^5$ nm/RIU. The calculated $\Delta f/\Delta n$ or $\Delta\lambda/\Delta n$, which may be a sensitivity measure of the PPWG integrated resonator, may be more than an order of magnitude higher than the highest theoretical value reported in the THz regime for a photonic crystal based sensor and about an order of magnitude higher than the highest values reported in the optical regime for a surface Plasmon based sensor.

Figure 11:
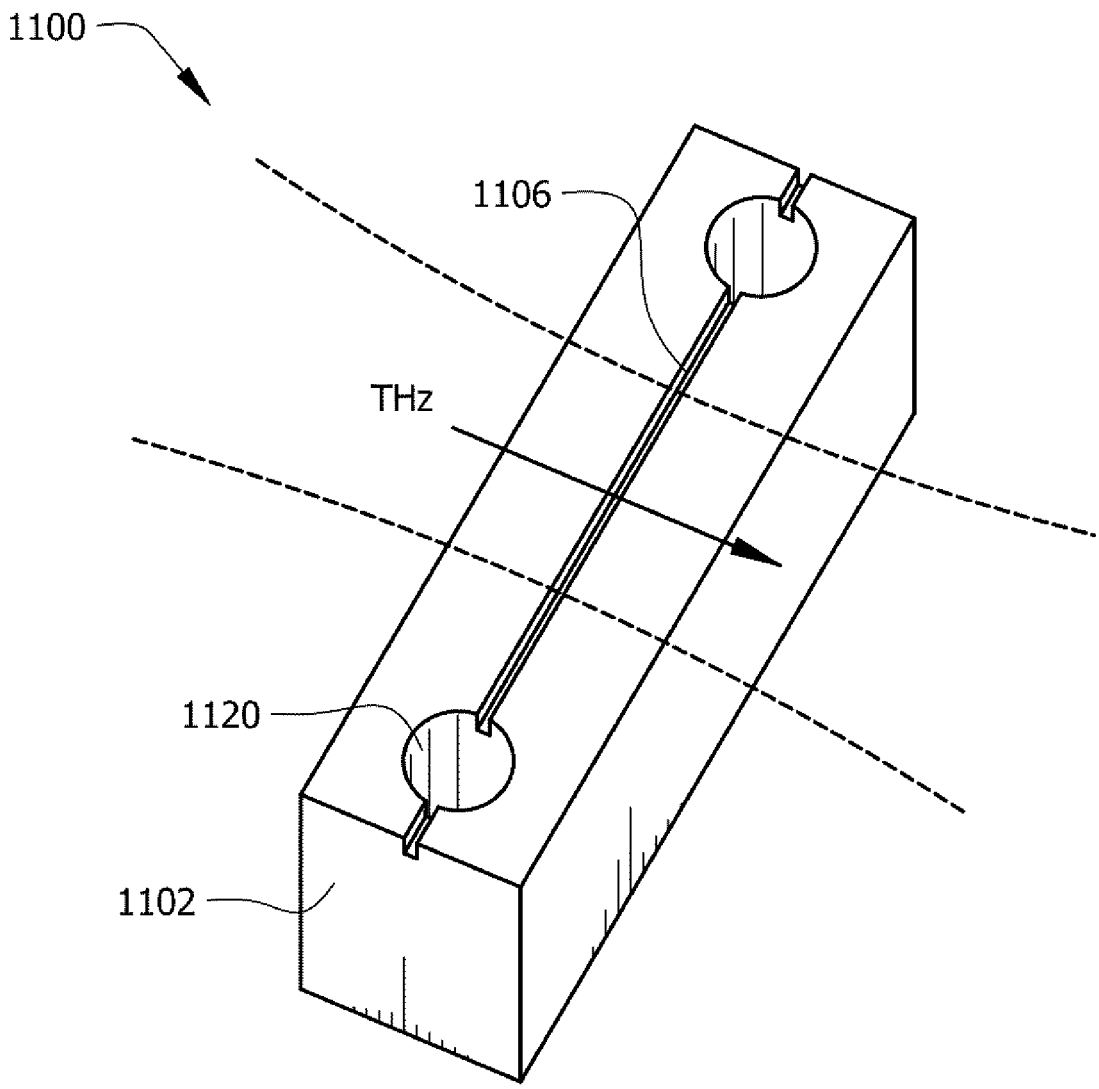
FIG. 11 is a view of another embodiment of a PPWG integrated resonator prototype.

FIG. 11 illustrates a PPWG integrated resonator prototype 1100, which comprises a top plate 1102 that comprises a cavity 1106. The PPWG integrated resonator prototype 1100 may also comprise a bottom plate coupled to the top plate via a plurality of mounting holes 1120. The components of the PPWG integrated resonator prototype 1100 may be configured similar to the corresponding components of the PPWG integrated resonator prototype 600. However, since the cavity 1106 is positioned in the top plate 1102 instead of the bottom plate, the PPWG integrated resonator prototype 1100 may not hold a fluid without covering the cavity by a thin dielectric layer. Specifically, the separation between the two plates b is equal to about one millimeter, the width w of the two plates is equal to about 6.4 millimeters, and the cavity width d is equal to about 538 micrometers. Additionally, the PPWG integrated resonator prototype 1100 may be coupled to a transmitter at one face and to a receiver at the other opposite face, similar to the PPWG integrated resonator prototype 600. The transmitter may also be coupled to a lens or any quasi-optics for coupling a wave beam from the transmitter to the PPWG integrated resonator prototype 600.

Figure 12:
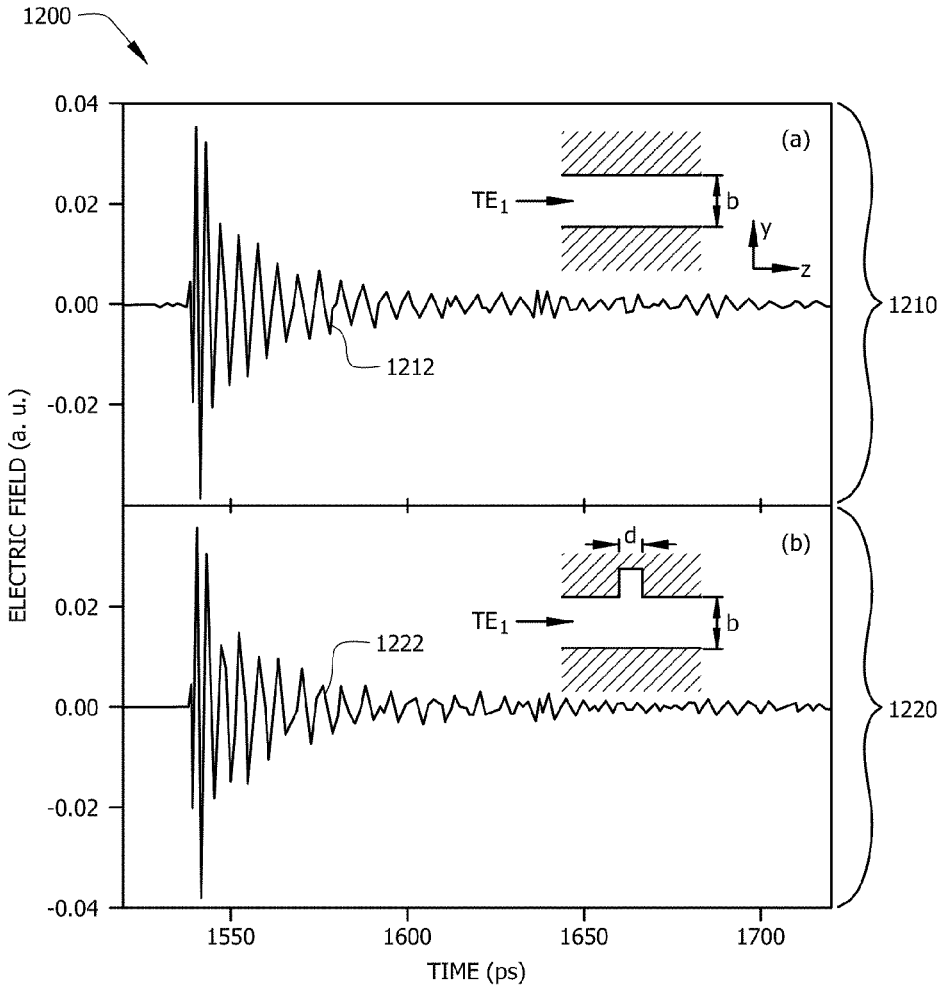
FIG. 12 is a chart of another embodiment of a plurality of time pulses.

FIG. 12 illustrates a first plot 1210 and second plot 1220, which comprise a first time pulse 1212 and a second time pulse 1222, respectively. The first time pulse 1212 corresponds to a $TE_1$ mode wave that was transmitted at THz frequencies through a PPWG, which is configured similar to the PPWG integrated resonator prototype 1100 but without a cavity in the top plate. The second time pulse 1222 corresponds to a $TE_1$ mode wave that was transmitted at the same THz frequencies through the PPWG integrated resonator prototype 1100. The THz radiation may be generated using a similar configuration as the PPWG integrated resonator prototype 600. The first time pulse 1212 and second time pulse 1222 are chirped and broadened due to group velocity dispersion.

Figure 13:
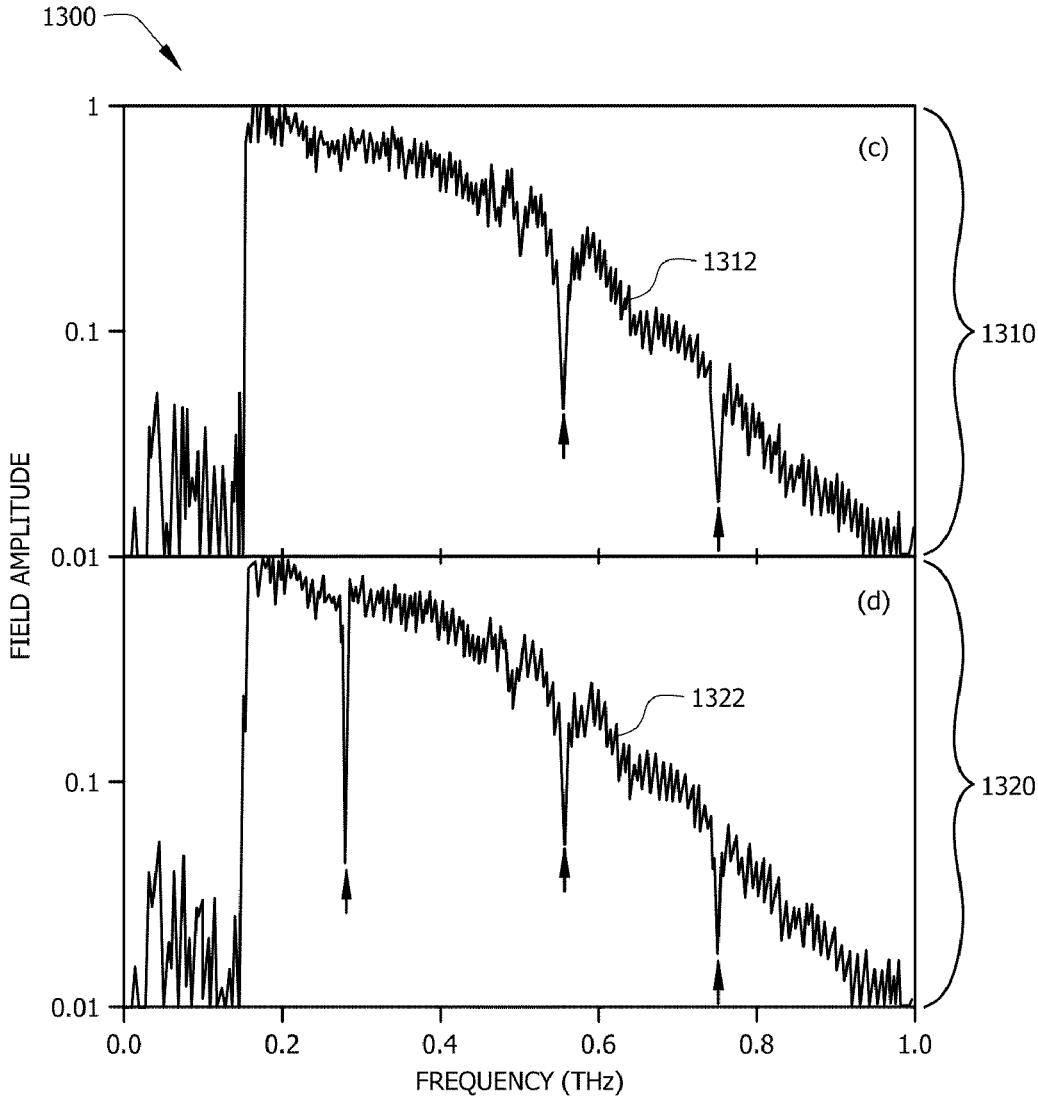
FIG. 13 is a chart of another embodiment of a plurality of frequency dependent wave amplitude plots.

FIG. 13 illustrates a frequency dependent wave amplitude plot 1300 for the detected $TE_1$ mode pulses in FIG. 12 for the PPWG integrated resonator prototype 1100. In FIG. 13, the amplitudes spectra are obtained using Fourier transforms of the $TE_1$ mode pulses at about 320 picoseconds and zero-padding to about 5,120 picoseconds. The frequency dependent wave amplitude plot 1300 comprises a first wave amplitude curve 1312 and a second wave amplitude curve 1322 that represent the detected wave amplitudes for the PPWG with no cavity and the PPWG integrated resonator prototype 1100, respectively, at a plurality of THz frequencies from about zero to about one THz. The time pulses for the two corresponding $TE_1$ modes have a cutoff frequency $f_c$ equal to about 0.15 THz and two apparent water-vapor absorption lines at about 0.557 THz and about 0.752 THz. Additionally, the second wave amplitude curve 1322 exhibits a narrow dip in amplitude across the spectrum, which may be caused by the resonant cavity. The dip in amplitude is located at a corresponding resonant frequency equal to about 0.28 THz, which is slightly different than the resonant frequency of the PPWG integrated resonator prototype 600 at about 0.293 THz.

Figure 14:
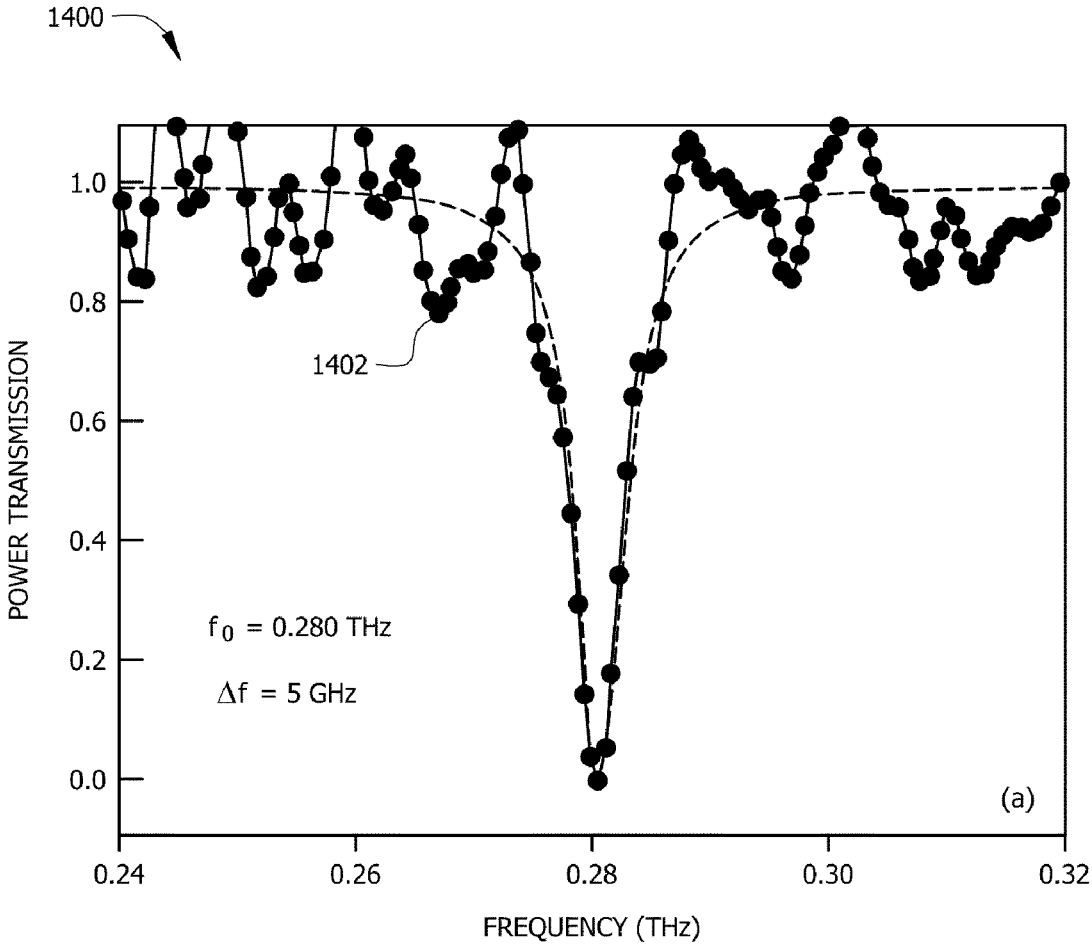
FIG. 14 is a chart of another embodiment of a frequency dependent transmission plot.

FIG. 14 illustrates a frequency dependent transmission plot 1400 for the PPWG integrated resonator prototype 1100. The frequency dependent transmission plot 1400 comprises a transmission curve 1402 corresponding to the second wave amplitude curve 1322. Specifically, the transmission curve 1402 represents a power transmission spectrum for the PPWG integrated resonator prototype 1100, and was obtained similar to the second transmission curve 904. The values in the transmission curve 1402 are shown using black dots. Additionally, the transmission values are fitted using a Lorentzian shape line. The Lorentzian shape fit for the transmission curve 1402 indicates a resonance at about 0.28 THz, a linewidth of about five GHz at about three decibels around the dip in transmission, and an extinction coefficient of about 30 decibels. The Q factor of the obtained transmission curve is equal to about 56, which may not be larger than other resonant structures used for THz frequencies.

The resonant frequency may also be calculated based on an established resonant frequency expression for an air filled generalized 3 dimensional (3D) cavity given by $$f_r = \frac{c}{2}\sqrt{\left(\frac{m_1}{d_1}\right)^2 + \left(\frac{m_2}{d_2}\right)^2 + \left(\frac{m_3}{d_3}\right)^2},$$

where $f_r$ is the calculated resonant frequency, $d_1$, $d_2$, and $d_3$ are the dimensions of the three cavity sides, and $m_1$, $m_2$, and $m_3$ are positive integers, which may also be equal to zero depending on the reduced dimensionality of the cavity (e.g. 2D or 1D). Since, the cavity of the PPWG integrated resonator prototype 1100 is defined as a 1D square groove, where $m_1=1$, $m_2=0$, $m_3=0$, and $d_1=d$, the calculated resonant frequency $f_r$ is equal to about 0.297 THz. The calculated $f_r$ is in good agreement with the experimental resonant frequency at about 0.28 THz.

Figure 15:
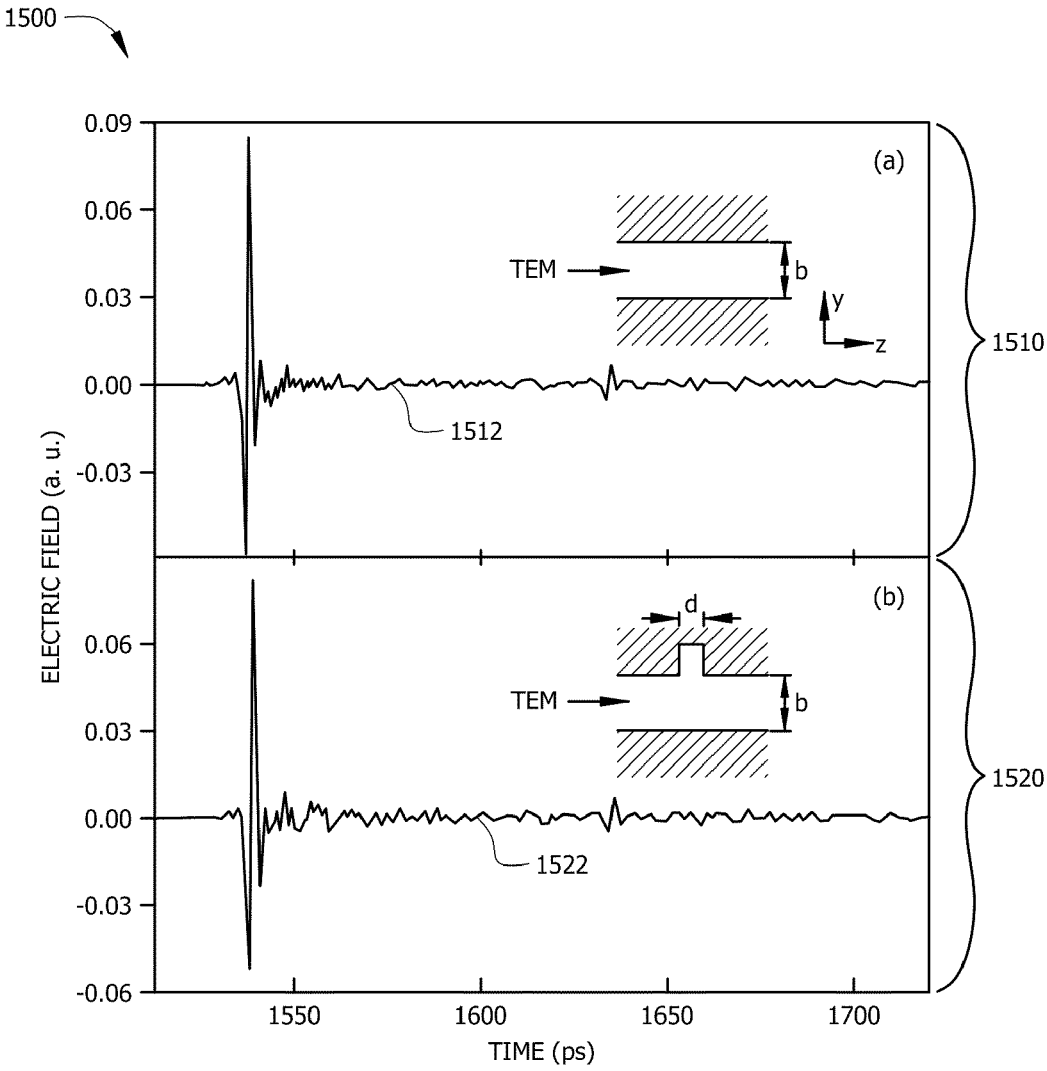
FIG. 15 is a chart of another embodiment of a plurality of time pulses.

FIG. 15 illustrates a first plot 1510 and second plot 1520, which comprise a first time pulse 1512 and a second time pulse 1522, respectively. The first time pulse 1512 corresponds to a TEM mode wave that was transmitted at the same THz frequencies for the $TE_1$ mode case above through the PPWG with no cavity and the second time pulse 1522 corresponds to a TEM mode wave that was transmitted at the same THz frequencies through the PPWG integrated resonator prototype 1100. The first time pulse 1512 and second time pulse 1522 comprise no chirp and no pulse broadening compared to the $TE_1$ mode waves in FIG. 12.

Figure 16:
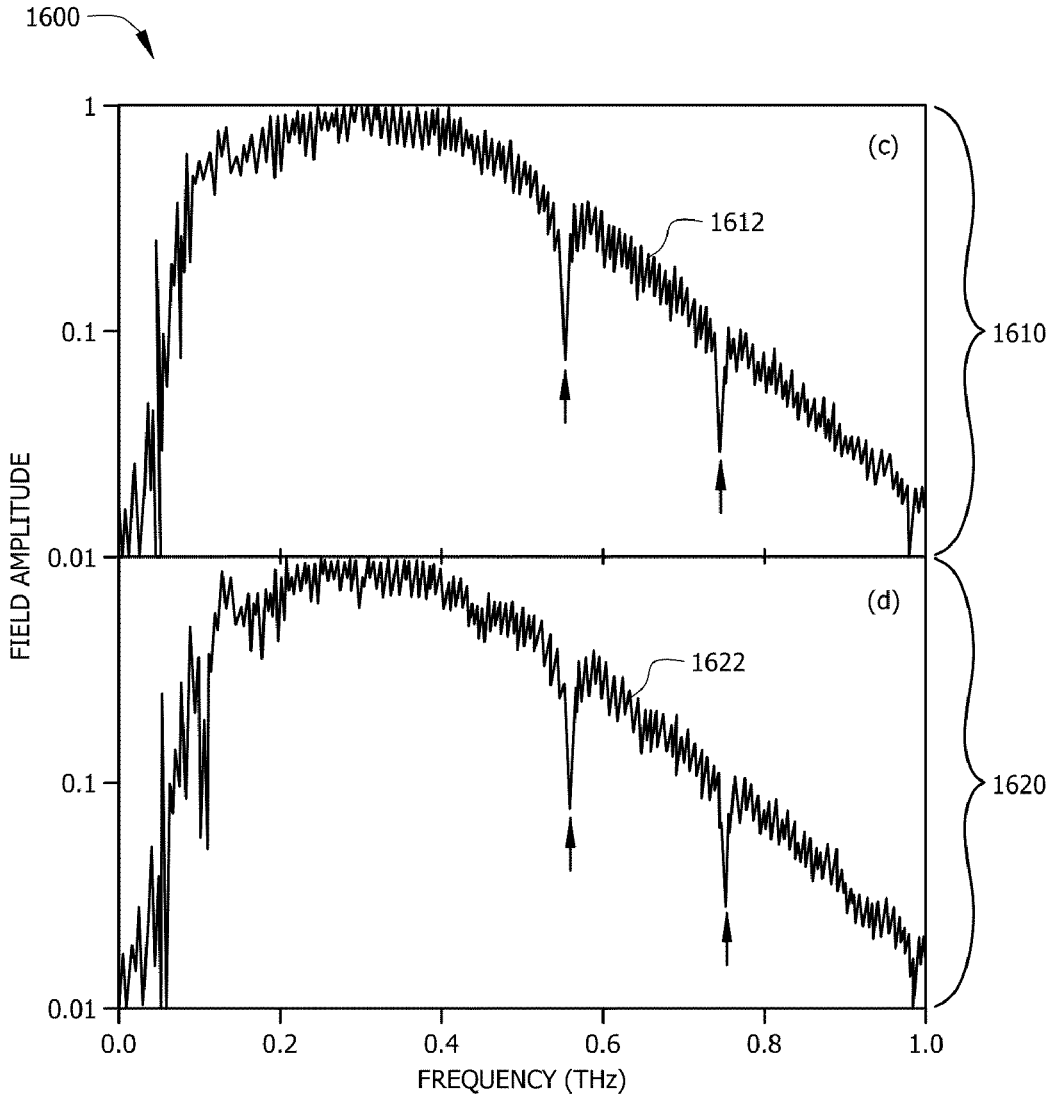
FIG. 16 is a chart of another embodiment of a plurality of frequency dependent wave amplitude plots.

FIG. 16 illustrates a frequency dependent wave amplitude plot 1600 for the detected TEM mode pulses in FIG. 15. In FIG. 16, the amplitudes spectra are obtained using Fourier transforms of the TEM, similar to the $TE_1$ case above. The frequency dependent wave amplitude plot 1600 comprises a first wave amplitude curve 1612 and a second wave amplitude curve 1622 that represent the detected wave amplitudes for the PPWG with no cavity and the PPWG integrated resonator prototype 1100, respectively, at a plurality of THz frequencies from about zero to about one THz. The wave amplitudes for the two corresponding TEM modes have two apparent water-vapor absorption lines at about 0.557 THz and about 0.752 THz but do not have a cutoff frequency as in the case of the $TE_1$ mode. Additionally, the time pulses for the two TEM modes do not exhibit a localized resonance dip in amplitude even in the presence of the cavity. The cavity in the device may not cause a substantial difference in response in comparison to the case of a PPWG without a cavity, which may indicate that the presence of the cavity may not substantially perturb the TEM propagating mode. This may also reveal that unlike the case of the $TE_1$ mode, which may have a better matched orientation with the cavity, the TEM mode may not excite the cavity and cause a significant resonance response. The presence of significant pulse broadening for $TE_1$ mode in comparison to the TEM mode may not necessarily inhibit the use of the PPWG integrated resonator for THz sensing applications. For instance, the $TE_1$ mode dispersion may be reduced by increasing the separation distance b. However, increasing the separation distance b may also weaken the resonance response, e.g. reduce the dip in transmission, decrease the sensitivity to refractive index or material changes, and/or reduce the coupling between the transmitted wave and the cavity.

Figure 17:
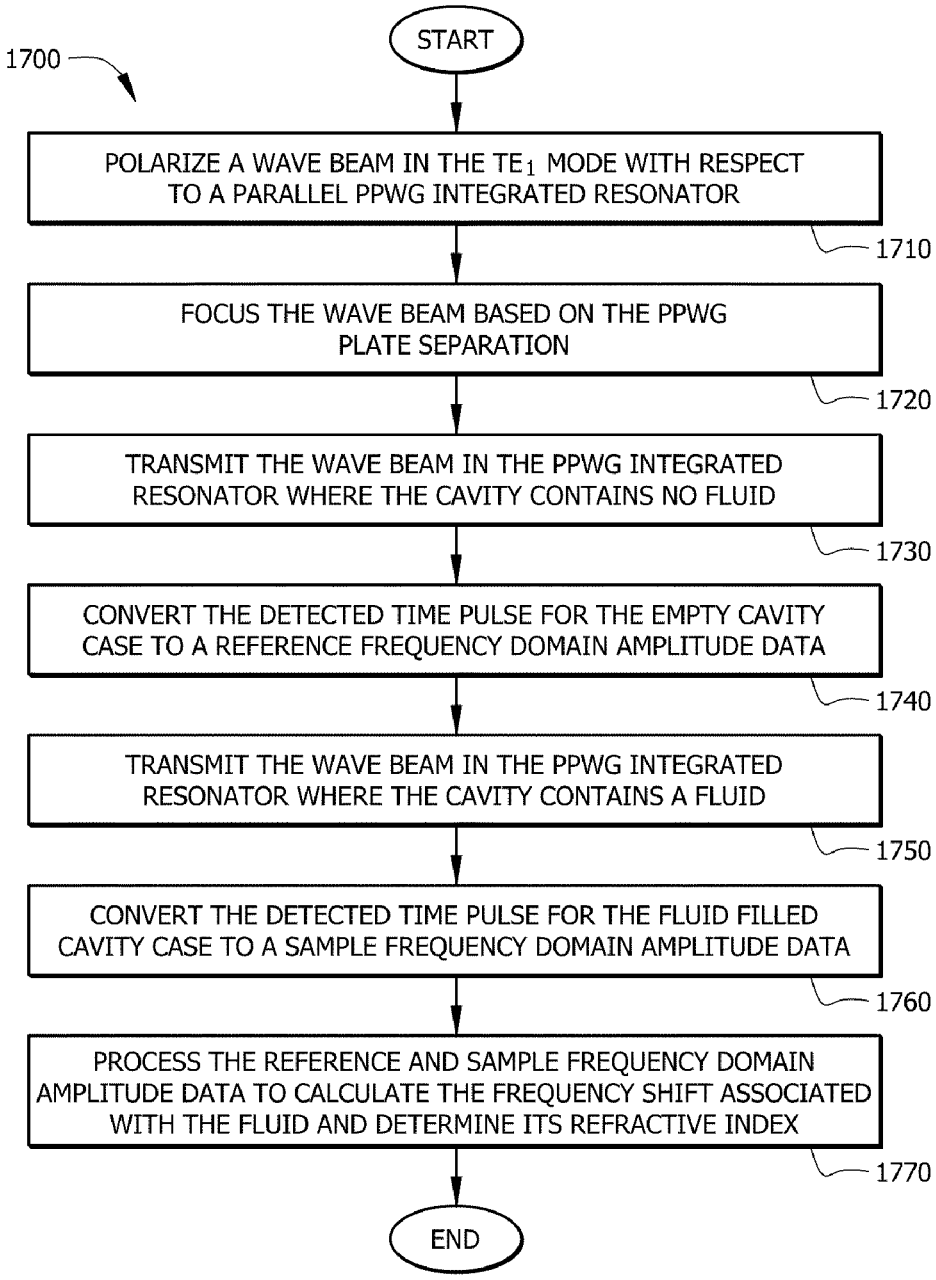
FIG. 17 is a flowchart of an embodiment of a refractive index sensing method.

FIG. 17 illustrates an embodiment of a refractive index sensing method 1700, which may be implemented using the PPWG integrated resonator. At block 1710, a wave beam may be polarized to excite the $TE_1$ mode with respect to the PPWG integrated resonator. For instance, the wave beam may be initially transmitted at a single or a plurality of THz frequencies using an antenna or a THz laser. The electric field component of the wave beam may be aligned, for instance, by rotating the antenna or laser, or using a polarizer, or alternatively rotating the PPWG to excite the $TE_1$ mode. At block 1720, the wave beam may be focused based on the PPWG plate separation. The plates may be separated by a distance to excite only the single $TE_1$ mode depending on the size of the focused input beam. In an embodiment, the wave beam may be a Gaussian beam, which may be focused using a lens. The lens may be aligned with the PPWG and may be positioned to adjust the diameter of the Gaussian beam according to the separation distance between the plates to improve the coupling to the $TE_1$ mode of the PPWG and prevent higher modes from propagating. At block 1730, the wave beam may be transmitted in the PPWG integrated resonator where the cavity may contain no fluid to obtain reference measurements. At block 1740, the detected time pulse for the empty cavity case may be converted to a reference frequency domain amplitude data. For instance, the first time pulse 712 in the time domain in FIG. 7 may be converted using Fourier transforms to the first wave amplitude curve 802 in the frequency domain in FIG. 8. Returning to FIG. 17, at block 1750, the wave beam may be transmitted in the PPWG integrated resonator where the cavity may contain a fluid to obtain sample measurements. At block 1760, the detected time pulse for the fluid filled cavity case may be converted to a sample frequency domain amplitude data. For instance, the second time pulse 722 in FIG. 7 may be converted to the second wave amplitude curve 804 in the frequency domain in FIG. 8. Next, at block 1770 in FIG. 17, the reference and sample frequency domain amplitude data corresponding to the empty cavity case and the fluid filled cavity case may be processed, for instance using a computer model, to calculate the frequency shift associated with the fluid in the cavity and hence to determine the refractive index of the fluid. For example, as shown in FIG. 9, the shift in the resonant frequency ΔRF may be first obtained between the first transmission curve 902 corresponding to the first wave amplitude curve 802 and the second transmission curve 904 corresponding to the second wave amplitude curve 804. Next, as shown in FIG. 10, the change in refractive index associated with the shift in resonant frequency ΔRF may be calculated based on the ratio $\Delta f/\Delta n$ of the first resonant frequency shift curve 1010.

In an embodiment, a continuous flow of fluid may be provided through the cavity and continuous wave amplitude measurements may be obtained for the flow, which may be converted into continuous frequency domain amplitude data. The continuous frequency domain amplitude data may be processed to calculate a continuous resonant frequency shift in the flow and thus monitor continuous changes in the flow at about real time. In some embodiments, a narrowband THz source may be used instead of a broadband THz source to generate and transmit the $TE_1$ mode waves into the PPWG integrated resonator. For instance, a narrowband source with a limited tunability, e.g. about 10 percent, may be used to detect a substantially wide range of targets with varying refractive index values. The resonant frequency of the cavity may also be engineered by changing the dimensions of the cavity, e.g. the cavity width d and thickness (height) t.

In some embodiments, a plurality of PPWG integrated resonators, which may have different engineered plates (e.g. different separation distance b and/or width w) and/or different engineered cavities (e.g. having different cavity width d and height t, or different shapes other than a rectangular cross-section), may be combined in parallel to obtain a multiple sensor platform. The multiple sensor platform may be used in a single waveguide and may simultaneously comprise a reference target (e.g. air) and a sample target (e.g. fluid) in the cavity, which may eliminate the need to obtain reference and sample measurements separately or to replace the reference and sample fluids. For example, a plurality of PPWG integrated resonators may be coupled in parallel, where each resonator may comprise the same or different cavities. Each cavity may be filled with a different fluid, which may be a reference fluid of known refractive index or a sample fluid of unknown refractive index. Each cavity may then be excited using the $TE_1$ mode to cause a resonance response and detect a corresponding wave amplitude. The shifts in resonance frequencies in the wave amplitudes may then be obtained and processed to determine the changes in refractive index of the sample fluid(s) with respect to the reference fluid(s).

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A method comprising:

polarizing and coupling an electromagnetic beam to a first-order transverse electric ($TE_1$) mode with respect to a parallel plate waveguide (PPWG) integrated resonator comprising two plates and a cavity;

sending the electromagnetic beam into the PPWG integrated resonator to excite the cavity by the $TE_l$ mode and cause a resonance response; and obtaining wave amplitude data that comprises a resonant frequency.

2. The method of claim 1 further comprising focusing the electromagnetic beam based on a separation distance between the two plates.

3. The method of claim 2, wherein the electromagnetic beam is focused by adjusting its diameter with respect to the separation distance between the two plates to prevent multimode wave propagation in the PPWG integrated resonator.

4. The method of claim 1 further comprising:

sending the electromagnetic beam when the cavity comprises a reference fluid; and detecting a corresponding reference time pulse to obtain reference amplitude measurements.

5. The method of claim 4 further comprising:

transmitting the electromagnetic beam when the cavity comprises a sample fluid; and detecting a corresponding sample time pulse to obtain sample amplitude measurements.

6. The method of claim 5 further comprising:

converting the reference amplitude measurements into reference frequency domain amplitude data comprising a dip in transmission around a reference resonant frequency;

converting the sample amplitude measurements into sample frequency domain amplitude data comprising a dip in transmission around a sample resonant frequency; and calculating a resonant frequency shift between the sample resonant frequency and the reference resonant frequency.

7. The method of claim 6 further comprising obtaining a refractive index of the sample fluid based on a refractive index of the reference fluid and the resonant frequency shift.

8. The method of claim 6, wherein the dip in transmission has a linewidth that improves the resolution of refractive index detection of the sample fluid.

9. The method of claim 8, wherein the linewidth of the dip in transmission is less than about ten Gigahertz (GHz).

10. The method of claim 9, wherein the resonant frequency shift is substantially larger than the linewidth of the dip in transmission and improves the sensitivity of refractive index detection of the sample fluid.

11. The method of claim 1 further comprising:

providing a continuous flow of fluid through the cavity;

obtaining continuous wave amplitude measurements for the flow;

converting the continuous wave amplitude measurements into continuous frequency domain amplitude data; and calculating a continuous resonant frequency shift based on the continuous frequency domain amplitude data to monitor continuous changes in the flow at about real time.

12. The method of claim 11, wherein the continuous resonant frequency shift corresponds to a continuous change in index of refraction in the flow.

13. The method of claim 1 further comprising:

polarizing and coupling a second electromagnetic beam to the $TE_1$ mode with respect to a second PPWG integrated resonator comprising two second plates and a second cavity and coupled in parallel to the PPWG integrated resonator;

sending the second electromagnetic beam into the second PPWG integrated resonator to excite the cavity by the $TE_1$ mode and cause a resonance response at about the same time as the electromagnetic beam in the PPWG integrated resonator; and obtaining a second wave amplitude data that comprises a second resonant frequency at about the same time as the wave amplitude data of the PPWG integrated resonator.

14. An apparatus comprising:

two plates substantially parallel to one another and separated by less than about two millimeters; and an antenna coupled to the two plates and configured to transmit or receive a wave having a frequency in a range of frequencies between about one Gigahertz (GHz) to about ten terahertz (THz), wherein the antenna is further configured to couple a first-order transverse electric ($TE_1$) mode into the two plates, and wherein one of the two plates comprises a groove machined along its length that has a resonance response for the $TE_1$ mode in the range of frequencies.

15. The apparatus of claim 14 further comprising:

an inlet at one end along the groove configured to allow a fluid to flow inside the groove; and an outlet at the other end along the groove and configured to allow the fluid to flow outside the groove.

16. The apparatus of claim 14, wherein the resonance response of the groove is determined by the width and height of the groove.

17. The apparatus of claim 14, wherein the groove is configured to interact with the $TE_1$ mode, cause higher concentration of energy near the cavity, and limit or cancel wave propagation away from the cavity.

18. The apparatus of claim 14, wherein the groove has different resonance responses at different resonant frequencies for different fluids in the groove, wherein the different resonance responses are substantially sensitive to refractive index differences of the fluids, and wherein the refractive index differences are detectable with substantially improved resolution.

19. The apparatus of claim 14, wherein the groove has no substantial resonance response when a transverse electric magnetic (TEM) mode is coupled into the two plates.

20. The apparatus of claim 14, wherein the two plates are coupled in parallel to a plurality of second two parallel plates, wherein one of each of the second parallel plates comprises a second groove or multiple grooves in the same set of two plates, and wherein the groove has a similar or different resonance response than the second groove.

* * * * *